United States Patent [19]

Henmi et al.

[11] 3,974,000

[45] Aug. 10, 1976

[54] SEMI-HARD MAGNETIC MATERIALS

[75] Inventors: Zenzo Henmi; Tatsuji Sasaki, both of Kawasaki; Masanori Okada; Makoto Kassai, both of Yokohama; Yuichi Suzuki, Kawasaki, all of Japan

[73] Assignee: Fujitsu Ltd., Japan

[22] Filed: Oct. 4, 1974

[21] Appl. No.: 512,311

Related U.S. Application Data

[63] Continuation-in-part of Ser. No. 286,885, Sept. 7, 1972, abandoned.

[30] Foreign Application Priority Data

Sept. 13, 1971 Japan ..... 46-71422
Feb. 29, 1972 Japan ..... 47-20716

[52] U.S. Cl. ..... 148/31.55; 75/123 K; 75/170; 148/120; 148/121

[51] Int. Cl.[2] ..... C04B 35/00

[58] Field of Search ..... 75/123 K, 170, 123 J, 75/128 B, 128 G; 148/31.55, 120, 121, 122

[56] References Cited

UNITED STATES PATENTS

| | | | |
|---|---|---|---|
| 1,792,483 | 2/1931 | Elmen | 148/31.55 |
| 3,390,443 | 7/1968 | Gould et al. | 148/31.55 |
| 3,615,910 | 10/1971 | Tomita et al. | 148/31.55 |
| 3,647,424 | 3/1972 | Majesko | 75/123 K |
| 3,686,042 | 8/1972 | Henmi et al. | 148/31.55 |
| 3,698,055 | 10/1972 | Holtz et al. | 75/123 K |
| 3,743,550 | 7/1973 | Masumoto et al. | 148/31.55 |

*Primary Examiner*—Walter R Satterfield
*Attorney, Agent, or Firm*—Nelson E. Kimmelman; Allan Ratner; Paul Maleson

[57] ABSTRACT

A semi-hard magnetic alloy is disclosed consisting essentially of 15 to 30% of Ni, 35 to 52% of Fe, 1 to 5% of Nb and the balance cobalt. This alloy possesses a coercive force (Hc) of 10 to 50 Oe, a magnetic flux density ($B_{100}$) of 10 to 17.5 KG., a squareness ratio ($Br/B_{100}$) of not less than 0.70 and a fullness ratio of not less than approximately 0.70. The alloy material is also characterized by a good plastic workability.

3 Claims, 11 Drawing Figures

SEMI-HARD MAGNETIC MATERIALS

This application is a continuation-in-part application of patent application Ser. No. 286,885, filed Sept. 7, 1972 and now abandoned.

The present invention relates to semi-hard magnetic alloys. These semi-hard magnetic alloys are particularly suitable for various switching elements and semipermanent memory devices.

In general, magnetic materials utilized in such applications as switching elements and semipermanent memory devices should preferably possess the following properties.

1. Both saturated magnetic flux density (Bs) and residual magnetic flux density (Br) are high.

2. The square hysteresis loop exhibits a high squareness ratio (Br/Bs) and a high "fullness factor". The term "fullness factor" used herein is represented by the formula:

$$\sqrt{(BH)_{max}/Br.Hc}$$

wherein $(BH)_{max}$ is the maximum magnetic energy product and Hc is coercive force.

3. The coercive force (Hc) is in the range between 10 and 50 Oe, preferably between 20 to 40 Oe.

In particular, the magnetic materials utilized in switching elements such as reed switches should preferably possess the following properties in addition to the above.

4. Even when the magnetic materials are exposed to a high temperature at the time of diffusion treatment or sealing to glass, the desired residual magnetic properties are not affected by the increase of temperature.

5. The thermal expansion coefficient of the magnetic materials is substantially equal to that of the glass material in order to secure a good sealability between the two materials.

6. Plastic workability is excellent, i.e. these materials are capable of being easily worked into any desired shape or size such as, for example, a fine wire rod having a diameter as small as less than 1 mm.

Known to the art from U.S. Pat. No. 1,792,483 is a magnetic material including nickel between 10 and 80%, cobalt between 5 and 80%, iron between 9 and 50%, up to 12% of chromium with at least one of molybdenum, tungsten, vanadium, titanium, tantalum, and zirconium.

In addition, a magnetic alloy consisting essentially of less than 30% cobalt, less than 30% iron, less than 5% of either copper or molybdenum and the balance nickel is proposed in U.S. Pat. No. 3,615,910. This alloy is subjected in turn to a hot-rolling, annealing, a cold-rolling, a stress relief annealing, and finally a magnetic annealing followed by a slow cooling under the magnetic field. Both of these prior U.S. Patents, however, do not provide the desired semi-hard magnetic materials, because the coercive force (Hc) is too low.

As semi-hard magnetic alloys, some cobalt-iron alloys have been heretofore proposed. For example, an alloy consisting of 48% iron, 48% cobalt, 3.5% vanadium and 0.5% manganese, all by weight, was announced under the name of "Remendur" by Western Electric Co., Ltd., U.S.A. (see "Bell Laboratories Record", page 257, June, 1965). A low magnetostriction permanent magnet alloy consisting of 82% cobalt, 12% iron and 6% gold was published in "Journal of Applied Physics", page 1268, February (Vol. 39), 1968. However, no semi-hard magnetic materials have heretofore been proposed which satisfy all the prerequisites listed above.

It is, therefore, an object of the present invention to provide the semi-hard magnetic materials which possess all the properties listed above and are excellent particularly in squareness ratio as well as fullness factor and, therefore, suitable for use as materials for magnetic devices such as reed switches and semipermanent memory devices.

In accordance with the present invention, there is provided a semi-hard magnetic alloy consisting essentially of 15 to 30% by weight of nickel 35 to 52% by weight of iron, 1 to 5% by weight of niobium and the balance cobalt, and having a coercive force of 10 to 50 Oe, preferably 20 to 40 Oe, a magnetic flux density at a magnetic field of 100 Oe, of 10 to 17.5 kilo-gauss and a squareness ratio of not lower than approximately 0.70, preferably approximately 0.80.

The alloy materials defined above may contain a trace amount of impurities incorporated during the production process. Also deoxidier or desulfurizer may be added to the alloy during melting, such as manganese, magnesium calcium, aluminum or silicon in an amount required for accomplishing the respective purpose. In general, the added amount of deoxidizer or desulfurizer is below 1% by weight.

The presence of niobium in the alloy material exercises a great effect on an increase in coercive force and squareness ratio of the alloy. However, if the content of niobium is in excess of 5% by weight, the magnetic flux density of the resulting alloy decreases and the workability thereof greatly deteriorates. In contrast, if the content of niobium is below 1% by weight, the effect of increasing the coercive force is too small to be practically satisfactory. The preferable content of niobium in the alloy is within the range from 2 to 4% by weight.

The content of nickel should be within the range from 15 to 30% by weight. If the content of nickel is below 15%, it is difficult to perform the desired cold working. In contrast, if the content is higher than 30%, the saturation magnetization ($\sigma_s$) of the alloy material is too low. The content of nickel is preferably within the range from 20 to 26% by weight.

The content of iron should be within the range from 35 to 52% by weight, preferably 37 to 52% by weight and more preferably 47 to 52% by weight. If the content of iron is too small, the squareness ratio is too low. In contrast, if the content of iron is higher than 52%, it is difficult to perform the desired cold working.

In order to provide the alloy material with the required magnetic properties, the alloy composed of the ingredient as defined above should be subjected to the process comprising the steps of working an ingot of the alloy into a wire-rod, subjecting the wire-rod to a final process annealing at a temperature of not lower than 600°C, preferably 600°C to 900°C, and to a final cold working at a reduction of area of not less than 75%, and a final heat treatment, i.e. ageing treatment, at a temperature of not higher than 800°C. In general, the ingot is formed step by step into the wire-rod by a hot working and subsequently cold workings in multistages. While the ingot is worked into the wire-rod one or more process annealings at a temperature not lower than 600°C are preferably inserted at suitable intervals during the reduction of area. The wire-rod so formed should be further subjected to a final process annealing and final cold-working and, thereafter, a final heat treatment.

If the final process annealing is carried out a temperature lower than 600°C, the plastic workability of the alloy materials is not improved and, therefore, it is difficult to reach the desired reduction of area during the cold working. For optimum results, the process annealing is carried out at a temperature of 600°C to 900°C, because the squareness ratio and the fullness factor are remarkably improved.

If the final reduction of area is below 75%, both the coercive force (*Hc*) and the magnetic flux density ($B_{100}$) of the resulting alloy material are low.

The alloy material so treated is preferably subjected to final heat treatment i.e. ageing at a temperature lower than 800°C. This final heat treatment contributes to enhancement of the squareness ratio to an extent of more than approximately 0.95. If the temperature exceeds 800°C, the squareness ratio and the coercive force become low.

It is to be noted that the desired magnetic properties can be obtained when the temperatures of the final process annealing and ageing treatment are properly determined within the above-mentioned ranges depending on the chemical composition of the alloy material.

The present invention will be illustrated in detail by way of examples.

EXAMPLE 1

Mixtures, each consisting of cobalt, iron, nickel and niobium in the proportions as shown in Table I and a trace amount of silicon were prepared from five metal materials: cobalt, electrolytic iron, nickel, ferroniobium and a trace amount of silicon. Each mixture was melted in a crucible in a vacuum. The melt was then molded into an ingot. The ingot was subjected to hot working at a temperature of 1,100°C by means of a swaging machine. Thereafter, the ingot so treated was subjected to cold drawings in multi-stages to form a wire-rod by means of a swaging machine, a drawing bench and a wire drawing machine while process annealings at temperatures of 1,000°C to 1,100°C were inserted at suitable intervals during the reduction of area. The wire-rod was subjected to the final process annealing at temperatures of 1,000°C to 1,100°C and then to the cold-working at a final reduction of area of 92%, thereby obtaining the size of 0.6 mm diameter.

The term "final reduction of area" (in %) used herein is defined by the formula, $[(d_1^2-d_2^2)/d_1^2] \times 100$, wherein $d_1$ and $d_2$ are diameters of the rod before the final cold working and the wire-rod after the final cold working, respectively.

Table I

| Sample No. | Composition of alloy (in % by weight) Ni | Fe | Nb | Co |
|---|---|---|---|---|
| SH-001 (control) | 5 | 46 | 3 | 46 |
| SH-002 (control) | 10 | 43 | 3 | 44 |
| SH-003 (invention) | 15 | 35 | 3 | 47 |
| SH-004 (invention) | 20 | 38 | 3 | 39 |

Among the four alloy materials shown in Table I, two alloy materials, SH-001 and SH-002, could not be worked into the wire-rod due to the striking work hardening.

Figure 1:
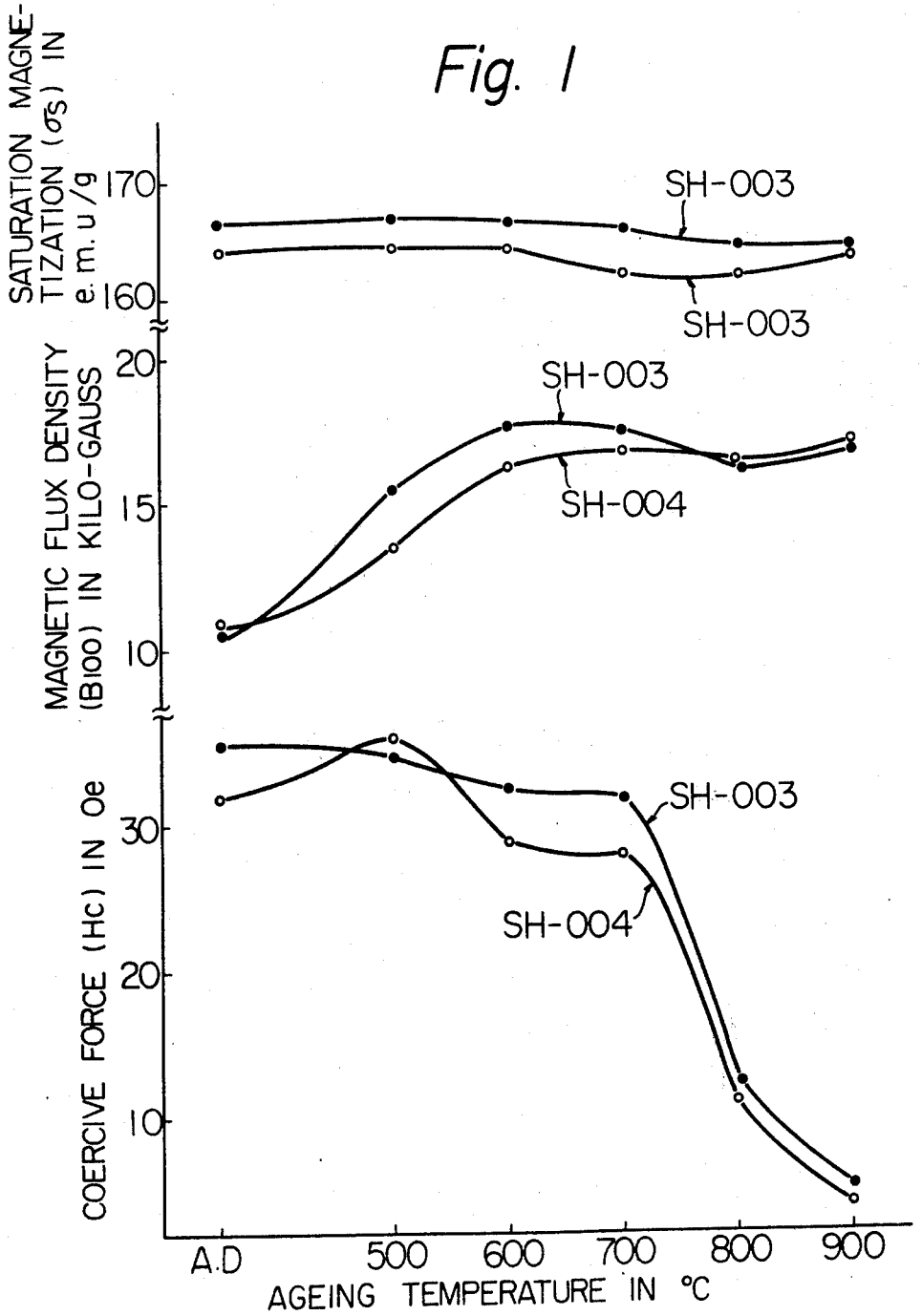
FIG. 1 is a set of graphs of various characteristics of the alloy according to the present invention as a function of aging temperature referred to in the discussion of Example 1.

Two wire-rods SH-003 and SH-004 were finally subjected to ageing treatment at various temperatures. Dependence of the magnetic property of the alloys SH-003 and SH-004 upon the temperature of the ageing treatment is shown in FIG. 1, accompanying herewith. In FIG. 1, the abscissa indicates the temperature of the ageing in centigrade, and the ordinate indicates the magnetic flux density ($B_{100}$) in kilo-gauss at a magnetic field of 100 Oe, the saturation magnetization ($\sigma_s$) in *e.m.u.* per unit mass and the coercive force (H*c*) in O*e*.

As apparent from FIG. 1, the saturation magnetization ($\sigma_s$) exhibits little or no variation depending upon the temperature of ageing, i.e. is nearly constant over all the ranges of the temperature. The coercive force (H*c*) also varies only slightly depending upon the temperature at the range of up to approximately 700°C. The magnetic flux densities ($B_{100}$) are high at the range of temperature higher than approximately 600°C.

EXAMPLE 2

Wire-rods of a diameter of 0.6 mm having the composition as shown in Table II were prepared using the corresponding amounts of cobalt, electrolytic iron, nickel and ferroniobium and a trace amount of silicon, in the same manner as that described in Example 1.

Table II

| Sample No. | Composition of alloy (in % by weight) Ni | Fe | Nb | Co |
|---|---|---|---|---|
| SH-005 (control) | 20 | 40 | O | 40 |
| SH-006 (invention) | 20 | 39 | 1 | 40 |
| SH-007 (invention) | 20 | 39 | 3 | 38 |
| SH-008 (invention) | 20 | 38 | 4 | 38 |
| SH-009 (invention) | 20 | 37 | 5 | 38 |

FIGS. 2 through 6 show dependence of the magnetic properties upon the content of niobium in % by weight in the alloys, in the case where the wire-rods were subjected to ageing treatment at temperatures of 600°C (curve 1) and 700°C (curve 2) in a vacuum for 1 hour. In these figures, curves marked with AD represent data of the wire-rods before the ageing treatment.

Figure 4:
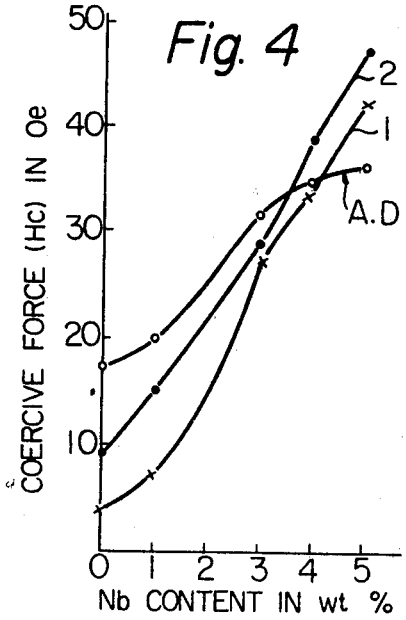

The following facts will be apparent from these figures. The coercive force (H*c*) increases with an increase in the content of niobium as shown in FIG. 4.

Figure 2:
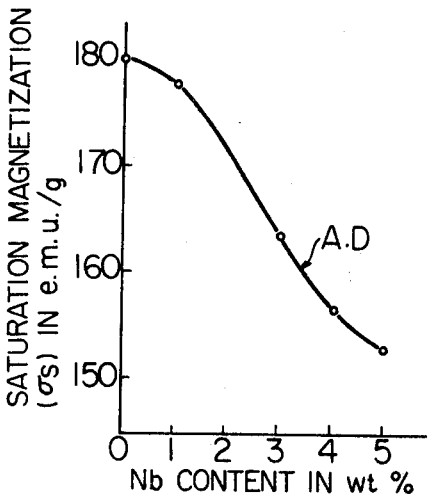
FIGS. 2–6 depict in graphical form the dependence of the magnetic properties of the novel alloy according to the present invention upon the niobium content thereof as discussed in connection with Example 2.
Figure 3:
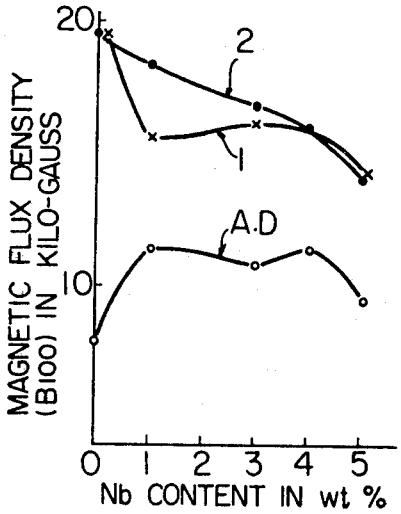
Figure 5:
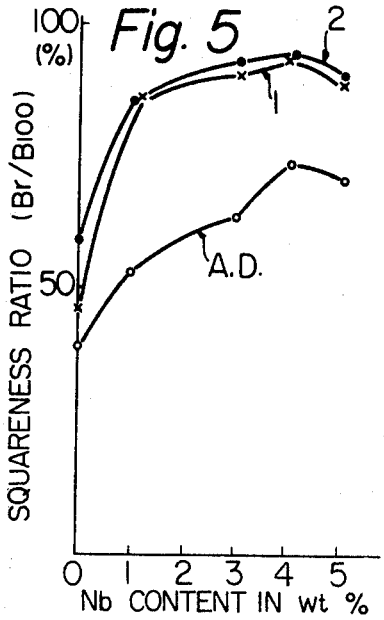
Figure 6:
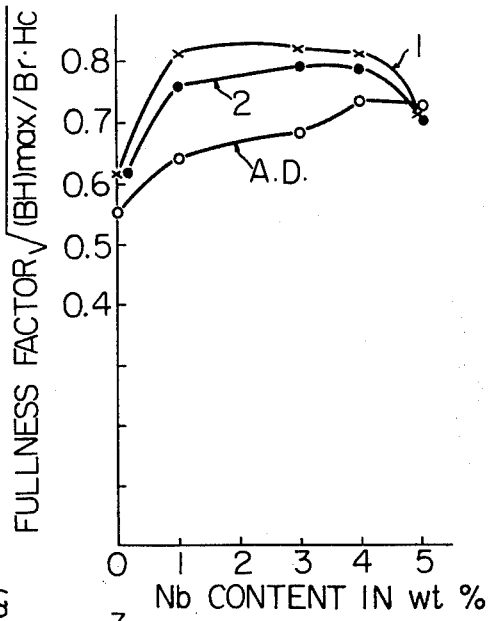

The saturation magnetization ($\sigma_s$) decreases with an increase in the content of niobium as shown in FIG. 2. The magnetic flux density ($B_{100}$) of the wire-rods subjected to the ageing at temperatures of 600°C and 700°C are remarkably high as compared with that of the wire-rod before the ageing, as shown in FIG. 3. Both the squareness ratio ($Br/B_{100}$) and the fullness factor ( $\sqrt{(BH)_{max}/Br.Hc}$) are high at the content of niobium ranging from 1% to approximately 5%, and; the squareness ratio and fullness factor of the wire-rods after the ageing treatment at temperatures of 600°C and 700°C are higher than those of the wire-rods before the ageing treatment, as shown in FIGS. 5 and 6.

Figure 7:
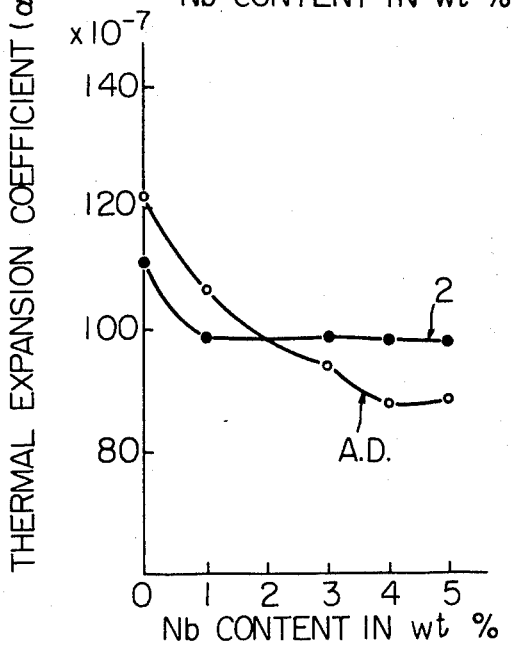
FIG. 7 depicts in graphical form the dependence of the thermal expansion coefficient upon the content of niobium in the novel alloy according to the present invention with special reference to Example 3.

FIG. 7 shows dependence of the thermal expansion coefficient ($\alpha$) upon the content of niobium. As shown in FIG. 7, the thermal expansion coefficient ($\alpha$) of the wire-rod before the ageing treatment greatly decreases with an increase in the content of niobium. In contrast, that ($\alpha$) of the wire-rod after the ageing treatment at a temperature of 700°C exhibits a nearly constant value, i.e. approximately $100 \times 10^{-7}$, at the content of niobium ranging from a very minor % to approximately 5%.

EXAMPLE 3

A metal mixture consisting of 20% by weight of Ni, 39% by weight of Fe, 3% by weight of niobium and 38% by weight of cobalt, was prepared from electrolytic iron, cobalt, nickel and ferroniobium. The mixture was melted in vacuum and then molded into an ingot. The ingot was subjected to hot working at a temperature of 1,100°C by means of a swaging machine. Thereafter, the ingot was subjected to cold workings in multi-stages to form seven wire rods by means of a swaging machine, a drawing bench and a wire drawing machine while process annealings at temperatures of 1,000°C to 1,100°C were inserted at suitable intervals during the reduction of area. The final process annealing, i.e. the process annealing immediately before the final cold drawing, was carried out at a temperature of 1,100°C. The final reductions of area of the seven wire-rods were as shown in Table III and each of the cold drawn wire-rods had a diameter of 0.6 mm.

Table III

| Sample No. | Final reduction of area in % |
|---|---|
| SH-010 | 0 |
| SH-011 | 30 |
| SH-012 | 51 |
| SH-013 | 64 |
| SH-014 | 75 |
| SH-015 | 92 |
| SH-016 | 97 |

Finally, these cold drawn wire-rods were subjected to ageing treatment at various temperatures shown in Tables IV and V. Dependence of the coercive force (Hc) in Oe and the magnetic flux density ($B_{100}$) of the wire-rods, so manufactured, upon the final reduction of area in % and the temperature of ageing treatment are shown in Tables IV and V, respectively.

Table IV

Coercive force (Hc) in Oe
Temperature of final process annealing: 1,100°C

| Temperature of ageing in °C \ Final reduction of area in % | 0 | 30 | 51 | 64 | 75 | 92 | 97 |
|---|---|---|---|---|---|---|---|
| AD | 0.5 | 11 | 19 | 24 | 27 | 31 | 28 |
| 400 | 0.5 | 15 | 23 | 30 | 34 | 41 | 39 |
| 600 | 0.5 | 15 | 21 | 25 | 29 | 31 | 29 |
| 700 | 0.5 | 11 | 18 | 23.5 | 25 | 26 | 24.5 |
| 800 | 0.5 | 4.3 | 8 | 9.5 | 10 | 12 | 10.5 |
| 900 | 0.5 | 0.5 | 0.5 | 0.8 | 1 | 3 | 1.5 |

Table V

Magnetic flux density ($B_{100}$) in kilo-gauss
Temperature of final process annealing: 1,100°C

| Temperature of ageing in °C \ Final reduction of area in % | 0 | 30 | 51 | 64 | 75 | 92 | 97 |
|---|---|---|---|---|---|---|---|
| AD | 16.5 | 7.2 | 6.6 | 6.2 | 7.2 | 9.0 | 10.0 |
| 400 | 16.5 | 6.8 | 6.2 | 6.7 | 7.4 | 11.6 | 12.1 |
| 600 | 16.5 | 7.4 | 7.6 | 8.4 | 10.0 | 14.5 | 16.1 |
| 700 | 16.5 | 10.0 | 10.5 | 11.4 | 12.6 | 15.0 | 15.6 |
| 800 | 16.5 | 15.0 | 14.4 | 14.4 | 14.6 | 15.3 | 15.4 |
| 900 | 16.5 | 15.0 | 15.9 | 16.0 | 16.0 | 16.0 | 16.0 |

Figure 8:
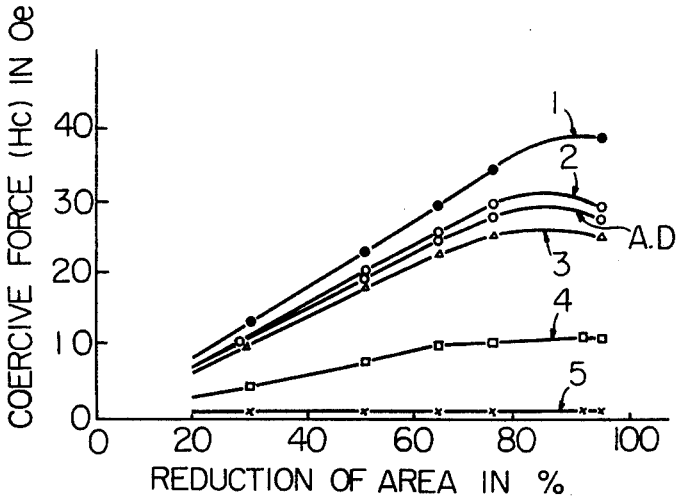
FIGS. 8 and 9 depict in graphical form the variations in coercive force and magnetic flux desnity as a function of the reduction of area with special reference to the data shown in Tables IV and V, respectively.
Figure 9:
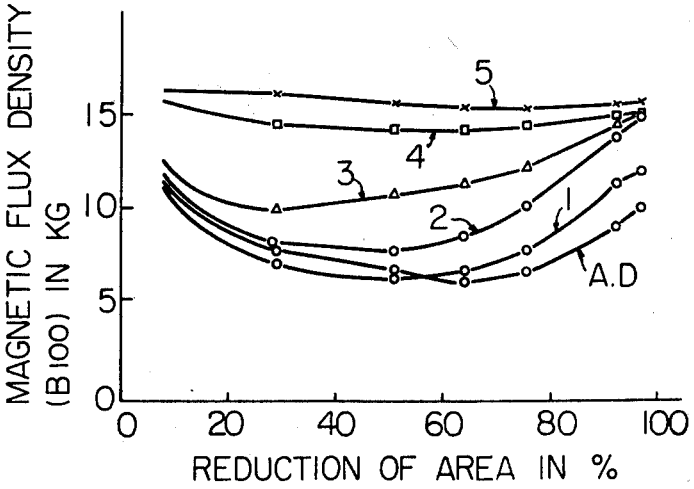

FIGS. 8 and 9 illustrate these data shown in Tables IV and V, respectively. In these figures, curves marked with numerical references 1, 2, 3, 4 and 5, indicate data of the wire-rods subjected to ageing treatment at temperatures of 400°C, 600°C, 700°C, 800°C and 900°C, respectively. In FIGS. 8 and 9, and Tables IV and V, AD means data of the wire-rod which was manufactured in the same manner as other wire-rods except that it was not subjected to any ageing treatment.

It will be apparent from these Tables and Figs. that both the magnetic flux density ($B_{100}$) and the coercive force (Hc) of the wire-rods subjected to the final process annealing at a temperature of 1,100°C, increase with an increase of the final reduction of area at the range of not lower than 75%. Accordingly, the semi-hard magnetic alloy material of the inventions should preferably be subjected to a final cold working at reduction of area not lower than 75% and then to ageing at a temperature preferably from 600° to 800°C.

EXAMPLE 4

The procedure of Example 3 was repeated wherein the final process annealing was carried out at temperatures of 700°C and 900°C, and the final reduction or area was varied as shown in Tables VI to IX with all other conditions remaining the same. The coercive force (Hc) and the magnetic flux density ($B_{100}$) of the wire-rods so manufactured are shown in Tables VI to IX.

Table VI

| Coercive force (Hc) in Oe<br>Temperature of final process annealing: 700°C<br>Temperature of ageing in °C / Final reduction of area in % | AD | 400 | 500 | 600 | 700 | 800 | 900 |
|---|---|---|---|---|---|---|---|
| 75 | 55 | 47 | 37 | 28 | 20 | 10 | 2.5 |
| 92 | 44 | 46 | 38 | 29 | 22 | 9 | 3 |
| 97 | 36 | 41 | 34 | 33 | 21 | 11 | 3 |

Table VII

| Magnetic flux density ($B_{100}$) in kilo-gauss<br>Temperature of final process annealing: 700°C<br>Temperature of ageing in °C / Final reduction of area in % | AD | 400 | 500 | 600 | 700 | 800 | 900 |
|---|---|---|---|---|---|---|---|
| 75 | 8.8 | 12.4 | 14.0 | 15.0 | 15.5 | 15.2 | 16.0 |
| 92 | 10.0 | 12.0 | 14.3 | 15.5 | 15.7 | 15.4 | 15.4 |
| 97 | 11.0 | 13.6 | 14.5 | 17.2 | 17.0 | 15.8 | 16.1 |

Table VIII

| Coercive force (Hc) in Oe<br>Temperature of final process annealing: 900°C<br>Temperature of ageing in °C / Final reduction of area in % | AD | 400 | 500 | 600 | 700 | 800 | 900 |
|---|---|---|---|---|---|---|---|
| 75 | 37 | 46 | 42 | 31 | 26 | 6 | 2.5 |
| 92 | 39 | 51 | 41 | 31 | 24 | 9 | 2.5 |
| 97 | 34 | 44 | 54 | 26 | 22 | 10 | 2.5 |

Table IX

| Magnetic flux density ($B_{100}$) in kilo-gauss<br>Temperature of final process annealing: 900°C<br>Temperature of ageing in °C / Final reduction of area in % | AD | 400 | 500 | 600 | 700 | 800 | 900 |
|---|---|---|---|---|---|---|---|
| 75 | 7.5 | 8.2 | 8.8 | 11.2 | 14.1 | 15.3 | 15.5 |
| 92 | 9.2 | 12.0 | 14.0 | 14.8 | 14.4 | 15.6 | 15.5 |
| 97 | 10.1 | 12.4 | 13.4 | 16.5 | 15.4 | 15.4 | 15.4 |

It will be apparent from Tables VI and VIII that the coercive force (Hc) reaches the maximum value at the temperature of ageing of approximately 400°C, and decreases with an increase of the temperature of ageing. The coercive force (Hc) is below approximately 10 Oe at the temperature of ageing exceeding 800°C. The magnetic flux density ($B_{100}$) in general increases of the final reduction of area and the temperature of ageing.

EXAMPLE 5

The procedure of Example 3 was repeated, wherein the final process annealing was carried out at 700°C, 900°C and 1,100°C, and the ageing treatment was carried out at 600°C, and the final reduction of area was 92% with all other conditions remaining the same.

Figure 10:
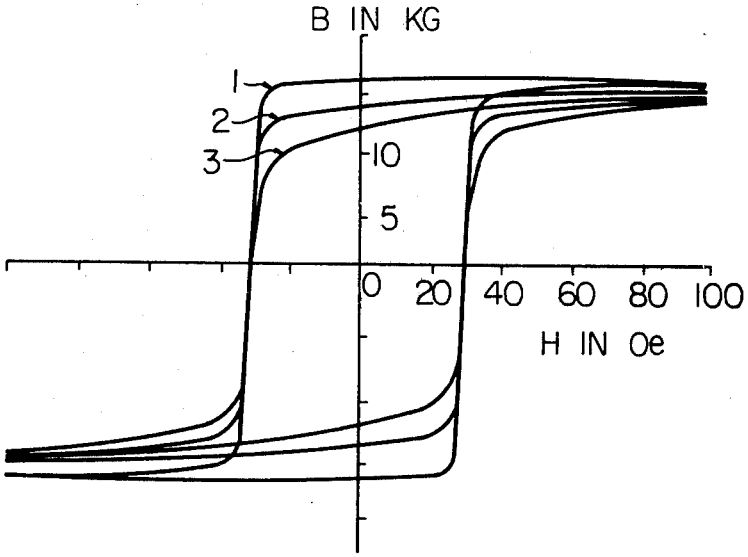
FIG. 10 depicts the hysteresis loop of the wire rods manufactured according to Example 5.

The hysteresis loops of the wire-rods so manufactured are shown in FIG. 10. In FIG. 10, curves marked with numerical references 1, 2 and 3 indicate data of the wire-rods subjected to the final process annealing at temperatures of 700°C, 900°C and 1,100°C, respectively. Representative data corresponding to the hysteresis loops are shown in Table X.

Table X

| Temperature of final process annealing in °C | Hysteresis loop: $B_{100}$ in kilo-gauss | Br in kilo-gauss | Hc in Oe | Squareness ratio $Br/B_{100}$ |
|---|---|---|---|---|
| 700 | 16.2 | 16.0 | 29 | 0.99 |
| 900 | 15.0 | 14.5 | 31 | 0.97 |
| 1,100 | 14.5 | 12.5 | 31 | 0.86 |

As apparent from FIG. 10, the lower the temperature of final process annealing, the higher both the squareness ratio and the fullness factor.

X-ray diffractiometry was carried out on these alloys and the following was found. The alloy subjected to the final process annealing at a temperature of 700°C exhibits a mixed phase of $\alpha$-phase having a body-centered cubic lattice structure and $\gamma$-phase have a face-centered cubic lattice structure. In contrast, the alloy subjected to the final process annealing at a temperature exceeding 900°C exhibits a single phase of the $\gamma$-phase. Further, it was found that the alloy exhibiting the mixed phase is superior in plastic workability, squareness ratio (above 0.95°) and fullness factor and, therefore, is excellent as a semi-hard magnetic material.

EXAMPLE 6

Figure 11:
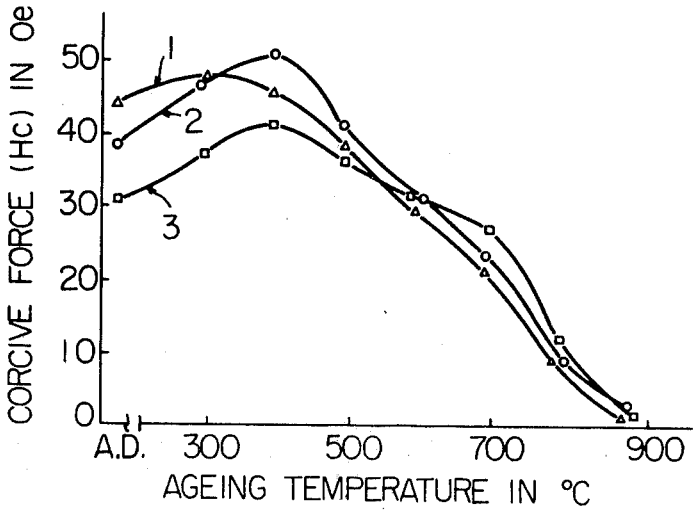
FIG. 11 depicts the variation in coercive force as a function of aging temperature with a special reference to Example 6.

The procedure of Example 5 as repeated, wherein the ageing treatment was carried out at various temperatures as shown in Table XI. The coercive force (Hc) of the alloy so treated was shown in Table XI and FIG. 11. In FIG. 11, curves marked with numerical references 1, 2 and 3 indicate data of the alloys subjected to the final process annealing at temperatures of 700°C, 900°C and 1,100°C, respectively.

Table XI

| Temperature of ageing in °C / Temperature of final process annealing in °C | Coercive force (Hc) in Oe | | | | | | | |
|---|---|---|---|---|---|---|---|---|
| | AD | 300 | 400 | 500 | 600 | 700 | 800 | 900 |
| 700 | 44 | 45.5 | 46 | 36 | 29 | 22 | 9 | 3 |
| 900 | 39 | 47 | 51 | 41 | 31 | 24 | 9 | 2.5 |
| 1,100 | 31 | 37 | 41 | 36 | 31 | 26 | 12 | 3 |

As is apparent from Table XI and FIG. 11, the coercive force (Hc) reaches the maximum value at the temperature of ageing of approximately 400°C and thereafter decreases with an increase of the temperature of ageing. When the temperature of ageing is higher than 800°C, the coercive force (Hc) is below approximately 10 Oe. Therefore, the ageing treatment should preferably be carried out at a temperature not higher than 800°C.

EXAMPLE 7

Wire-rods of a diameter of 0.6 mm having the composition as shown in Table XII were prepared using the corresponding amounts of cobalt, electrolytic iron, nickel and ferroniobium and a trace amount of silicon, in the same manner as that described in Example 1 except that the temperature of process annealings was 1,100°C and the final reduction of area was 98%.

Table XII

| Sample No. | Composition of alloy (in % by weight) Ni | Fe | Nb | Co |
|---|---|---|---|---|
| SH-020 (invention) | 23 | 52 | 3 | 22 |
| SH-021 (invention) | 23 | 47 | 3 | 27 |
| SH-022 (invention) | 23 | 37 | 3 | 37 |
| SH-023 (invention) | 26 | 51 | 3 | 20 |
| SH-024 (invention) | 26 | 46 | 3 | 25 |

Finally, these cold drawn wire rods were subjected to ageing treatment at a temperature shown in Table XIII. The coercive force (Hc), magnetic flux density ($B_{100}$) and squareness ratio ($Br/B_{100}$) of the wire rods so manufactured are shown in Table XIII.

Table XIII

| Sample No. | Magnetic properties SH-020 | SH-021 | SH-022 | SH-023 | SH-024 |
|---|---|---|---|---|---|
| Ageing Temp. in °C | 700 | 600 | 800 | 600 | 700 |
| Magnetic properties | | | | | |
| Coercive force (Hc) in Oe | 36 | 26 | 10 | 31 | 25 |
| Magnetic flux density ($B_{100}$) in KG | 15.5 | 16.5 | 15.0 | 17.0 | 13.5 |
| Squareness ratio ($Br/B_{100}$) | 0.97 | 0.97 | 0.77 | 0.97 | 0.78 |

What we claim is:

1. A worked and heat-treated semi-hard magnetic alloy consisting essentially of 15 to 30% by weight of nickel, 35 to 52% by weight of iron, 1 to 5% by weight of niobium and the balance cobalt, and having a coercive force of 10 to 50 Oe, a magnetic flux density at a magnetic field of 100 Oe, of 10 to 17.5 kilo-gauss, a squareness ratio of not lower than approximately 0.70 and also having a fullness factor not lower than approximately 0.70.

2. A semi-hard magnetic alloy according to claim 1, consisting essentially of 20 to 26% by weight of nickel, 37 to 52% by weight of iron, 2 to 4% by weight of niobium and the balance cobalt, and having a squareness ratio of not lower than approximately 0.80.

3. A semi-hard magnetic alloy according to claim 2, wherein the squareness ratio is not lower than approximately 0.95.

* * * * *